US008333461B2

(12) United States Patent
Qin et al.

(10) Patent No.: US 8,333,461 B2
(45) Date of Patent: Dec. 18, 2012

(54) INK CARTRIDGE FOR INKJET PRINTER

(75) Inventors: Lei Qin, Guangdong (CN); Xiuyuan Xu, Guangdong (CN); Xiaotian Ma, Guangdong (CN)

(73) Assignee: Zhuhai Ninestar Management Co., Ltd., Guangdong (CN)

( * ) Notice: Subject to any disclaimer, the term of this patent is extended or adjusted under 35 U.S.C. 154(b) by 268 days.

(21) Appl. No.: 12/796,883

(22) Filed: Jun. 9, 2010

(65) Prior Publication Data

US 2010/0265305 A1 Oct. 21, 2010

Related U.S. Application Data

(63) Continuation of application No. PCT/CN2008/073408, filed on Dec. 10, 2008.

(30) Foreign Application Priority Data

Dec. 10, 2007 (CN) ..... 2007 2 0305166 U

(51) Int. Cl.
*B41J 2/175* (2006.01)

(52) U.S. Cl. ..... 347/86; 347/7; 347/85; 250/577; 250/573

(58) Field of Classification Search ..... 347/86, 347/7, 85; 250/577, 573
See application file for complete search history.

(56) References Cited

U.S. PATENT DOCUMENTS 6,361,136 B1 * 3/2002 Watanabe et al. ..... 347/7
6,409,302 B2 * 6/2002 Altfather et al. ..... 347/19
6,726,313 B1 4/2004 Oda et al. ..... 347/85
7,147,312 B2 * 12/2006 Ujita ..... 347/86
2001/0035887 A1 11/2001 Altfather et al. ..... 347/7
2002/0070985 A1 * 6/2002 Takagi ..... 347/7
2003/0210289 A1 11/2003 Yoshiyama et al. ..... 347/7
2004/0104949 A1 * 6/2004 Morita et al. ..... 347/7
2004/0246283 A1 12/2004 Merz et al. ..... 347/7

(Continued)

FOREIGN PATENT DOCUMENTS

CN 1960878 5/2007

(Continued)

OTHER PUBLICATIONS

International Search Report of International Application No. PCT/CN2008/073408, dated Feb. 5, 2009.

(Continued)

*Primary Examiner* — Ellen Kim
(74) *Attorney, Agent, or Firm* — J.C. Patents

(57) ABSTRACT

An ink cartridge for an inkjet printer is provided. The ink cartridge includes a light detection portion, a first triangular prism and a second triangular prism, made of transparent material and disposed on the light detection portion, for receiving, deflecting, or refracting light emitted by a light emitting element on the printer. Two surfaces of the second triangular prism contact ink in the ink cartridge. When the ink cartridge has ink contained therein and is installed into a printer, the light emitted by the light emitting element is totally reflected by the first triangular prism and refracted by the second triangular prism into the ink, and will not be received by a light receiving element on the printer. When the ink in the ink cartridge is exhausted, the light is totally reflected by the second triangular prism onto the first triangular prism, and then is reflected onto the light receiving element, and thus the printer detects that the ink is exhausted.

10 Claims, 11 Drawing Sheets

U.S. PATENT DOCUMENTS

| | | | | |
|---|---|---|---|---|
| 2005/0139793 | A1 | 6/2005 | Merz | 250/577 |
| 2005/0236590 | A1 | 10/2005 | Kimura | 250/573 |
| 2006/0139384 | A1* | 6/2006 | Kitabatake et al. | 347/7 |
| 2006/0176348 | A1 | 8/2006 | Nishioka et al. | 347/86 |
| 2007/0052741 | A1* | 3/2007 | Yamamoto | 347/7 |
| 2009/0109266 | A1* | 4/2009 | Ogle et al. | 347/86 |
| 2010/0141719 | A1* | 6/2010 | Fukushima et al. | 347/86 |

FOREIGN PATENT DOCUMENTS

| | | | |
|---|---|---|---|
| CN | 1960878 | A | 5/2007 |
| CN | 201143794 | | 11/2008 |
| EP | 1 391 306 | | 2/2004 |
| JP | 2000-43282 | | 2/2000 |
| JP | 2000-43282 | A | 2/2000 |
| JP | 2000-71470 | | 3/2000 |
| JP | 2000-71470 | A | 3/2000 |
| JP | 2003-334970 | A | 11/2003 |
| JP | 2004-202796 | A | 7/2004 |
| JP | 2005-169689 | | 6/2005 |
| JP | 2005-169689 | A | 6/2005 |
| JP | 2005-305815 | A | 11/2005 |
| JP | 2007-276238 | A | 10/2007 |
| RU | 2 294 286 | C2 | 2/2007 |

OTHER PUBLICATIONS

Supplementary European Search Report of European Application No. 08 85 8916.3, dated Nov. 5, 2010.

Japanese Examination Report of Japan Application No. 2010-537241, dated Jul. 12, 2011.

Russian Authorization Text of Russia Application No. 2010125930/12, published as RU2 443 567 C1, dated Feb. 27, 2012.

* cited by examiner

INK CARTRIDGE FOR INKJET PRINTER

CROSS-REFERENCE TO RELATED APPLICATIONS

This application is a continuation of International Application No. PCT/CN2008/073408, filed on Dec. 10, 2008, which claims the priority of Chinese Patent Application No. 200720305166.X, filed on Dec. 10, 2007. The contents of the above identified applications are incorporated herein by reference in their entirety.

FIELD OF THE TECHNOLOGY

The present utility model relates to an ink cartridge for an inkjet printer, and more particularly to an ink cartridge with an optical detection element installed therein.

BACKGROUND

In existing inkjet printing technologies, some inkjet printers use an optical mechanism to detect whether the ink in the ink cartridge is exhausted, so as to avoid unrecoverable damages to the printer when the ink is exhausted while the printer is still printing, and prevent unnecessary waste of time and paper for users. In US patent application publication No. US2005195225, a solution is disclosed: a light emitting element and a light receiving element are disposed on a printer, and accordingly, a lever is disposed in an ink cartridge of the printer, a floating mark and a light shielding element are provided on two ends of the lever respectively, and a support in the middle of the lever is fixed at the bottom of an ink chamber of the ink cartridge. The ink cartridge has a detection portion protruding outwards and made of a transparent material, and the internal space of the detection portion is capable of accommodating the light shielding element. When the ink cartridge is installed into a printer, the detection portion is located between the light emitting element and the light receiving element. When the ink cartridge contains sufficient ink, the floating mark floats on the surface of the ink due to the buoyancy, and the light shielding element is located inside the detection portion, thus the light emitted from the light emitting element is blocked and the light receiving element cannot receive the light. When the ink in the ink cartridge is exhausted, because there is no buoyancy, the floating mark drops down, and the light shielding element moves upwards, such that the light receiving element receives the light emitted from the light emitting element. Accordingly the printer obtains information indicating that the ink is exhausted, and sends a signal to remind the user. The solution can effectively detect the moment when the ink is exhausted, but it has the disadvantages in the design of the lever: the installation of the floating mark is complicated, so the production efficiency of the ink cartridge is lowered. Furthermore, the light shielding element that moves with the change of the volume of the ink in the ink cartridge must be made of a non-transparent material. In the solution, a black PP material is used, so it is required that the black color master batch and the PP raw material be blended evenly during injection production. If they are not blended evenly or are blended not even enough, the ink cartridge cannot be identified after being installed into the printer. The light shielding element moves with the change of the volume of the ink in the ink cartridge, so a large number of parts are required, resulting in a complex production process.

SUMMARY

Accordingly, the present utility model is aimed to provide an ink cartridge for an inkjet printer, which can be manufactured with a simpler production process.

The above aim of the present utility model is realized as following:

An ink cartridge for an inkjet printer includes an ink supply port, an air vent, and an ink chamber for containing ink to be supplied to the printer and a light detection portion. The light detection portion comprises a first triangular prism and a second triangular prism formed by transparent material. Two side surfaces of the triangular prisms reflect or refract light emitted by a light emitting element on the printer.

According to an embodiment of the utility model, the ink cartridge has an ink supply port, an air vent and an ink chamber, which can be the same as those used in a conventional ink cartridge. A first triangular prism is disposed on a light detection portion outside of the ink cartridge and does not contact ink. The first triangular prism is adapted to totally reflect light, and a second triangular prism with no reflective paper attached thereto is disposed below the first triangular prism. The second triangular prism is positioned inside the ink cartridge and contacts the ink, and is adapted to refract and reflect light. The two triangular prisms are made of transparent material. When the ink cartridge is installed into a printer, the first triangular prism and the second triangular prism are located between a light emitting element and a light receiving element of the printer. When the ink cartridge contains sufficient ink and is installed into the printer for printing, a first surface of the first triangular prism totally reflects light emitted by the light emitting element of the printer onto a third surface of the second triangular prism. At this stage, as the space below the second triangular prism is filled with the ink, according to the refraction principle, the light is directly incident into the ink and cannot be received by the light receiving element of the printer, and accordingly the printer recognizes that the ink cartridge has ink contained therein. When the ink in the ink cartridge is exhausted, the ink adjacent to the second triangular prism in the ink cartridge is consumed. The first surface of the first triangular prism totally reflects the light emitted by the light emitting element of the printer onto the third surface of the second triangular prism. The light is incident onto a first surface of the second triangular prism through the third surface. Next, according to the total reflection principle, the light is reflected onto a second surface of the second triangular prism, and is reflected onto to a second surface of the first triangular prism, and then is reflected onto the light receiving element, and the printer prompts that the ink is exhausted and sends a signal to remind a user to replace the ink cartridge.

According to another aspect of the present utility model, reflective surfaces each made of two planes intersecting at right angle can be used. Two edges of the right angle protrude outwards at the detection portion of the ink cartridge.

According to another aspect of the present utility model, two curved surfaces are used as reflective surface, wherein one curved surface is attached with a reflective material so as to realize the detection function. The detailed content is described with reference to the embodiments.

According to another aspect of the present utility model, a metal reflective element is used as a reflective surface to replace the first triangular prism so as to realize the detection function. The detailed content is described with reference to the embodiments.

According to another aspect of the present utility model, the triangular prisms are made solid, and two side surfaces are attached with reflective paper so as to realize the detection function. The detailed content is described with reference to the embodiments.

The present utility model adopts the above technical solution and provides an ink cartridge structure which can be manufactured with a simpler production process and can be used in a conventional inkjet device. The present unity model realizes the detection function by taking advantage of the reflection principle and the refraction principle, so as to replace the above conventional light shielding element and floating mark and make the ink cartridge work more reliably.

BRIEF DESCRIPTION OF THE DRAWINGS

The present utility model will become more fully understood from the detailed descriptions given below. The descriptions are for illustration only and, thus, are not limitative of the present utility model, and wherein.

In the drawings.

| | | |
|---|---|---|
| 1- first triangular prism; | 2- second triangular prism; | 3- bottom shell; |
| 4- cover; | 5- seal membrane; | 6- gas guide membrane; |
| 7- side seal membrane; | 8- spring; | 9- valve core; |
| 10- seal ring; | 11- port-sealing membrane; | 12- light emitting element; |
| 13- light receiving element; | 14- first surface of the first triangular prism; | 15- second surface of the first triangular prism; |
| 16- first surface of the second triangular prism; | 17- second surface of the second triangular prism; | 18- third surface of the second triangular prism; |
| 19- ink; | 20- reflective paper; | 21- first right angle; |
| 22- second right angle; | 23- first outer surface; | 24- second outer surface; |
| 25- first inner surface; | 26- second inner surface; | 27- first curved surface; |
| 28- second curved surface; | 29- first curved reflective surface; | 30- second curved reflective surface; |
| 31- metal reflective element; | 32- positioning column. | |

DETAILED DESCRIPTION

Embodiments of the present utility model are further described in detail with reference to the accompanying drawings.

First Embodiment

Figure 1:
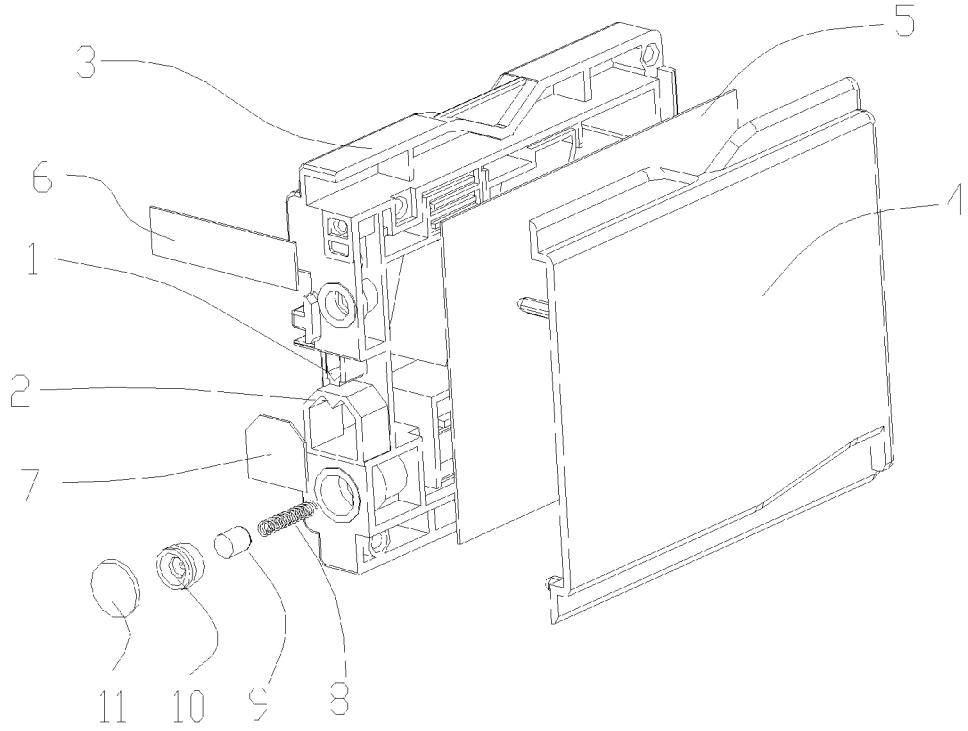
FIG. 1 is a structural schematic view of a first embodiment of the present utility model.

FIG. 1 is a structural schematic view of the ink cartridge of the first embodiment. Referring to FIG. 1, the structure of the ink cartridge includes a bottom shell 3, a cover 4, a gas guide membrane 6 provided on an air vent located on a sidewall of bottom shell 3, a side seal membrane 7; wherein a spring 8, a valve core 9, a seal ring 10 and a port-sealing membrane 11 are installed in an ink supply port; and the structure also includes a first triangular prism 1, a second triangular prism 2 and a seal membrane 5.

The first triangular prism 1 and the second triangular prism 2, which are made of transparent material, are disposed on the bottom shell 3 of the ink cartridge. A distance between the first triangular prism 1 and the second triangular prism 2 is 1-12 mm A space enclosed by a first surface 14 and a second surface 15 of the first triangular prism 1 is made hollow and filled with air or other substances having a density lower than that of plastic.

Figure 2:
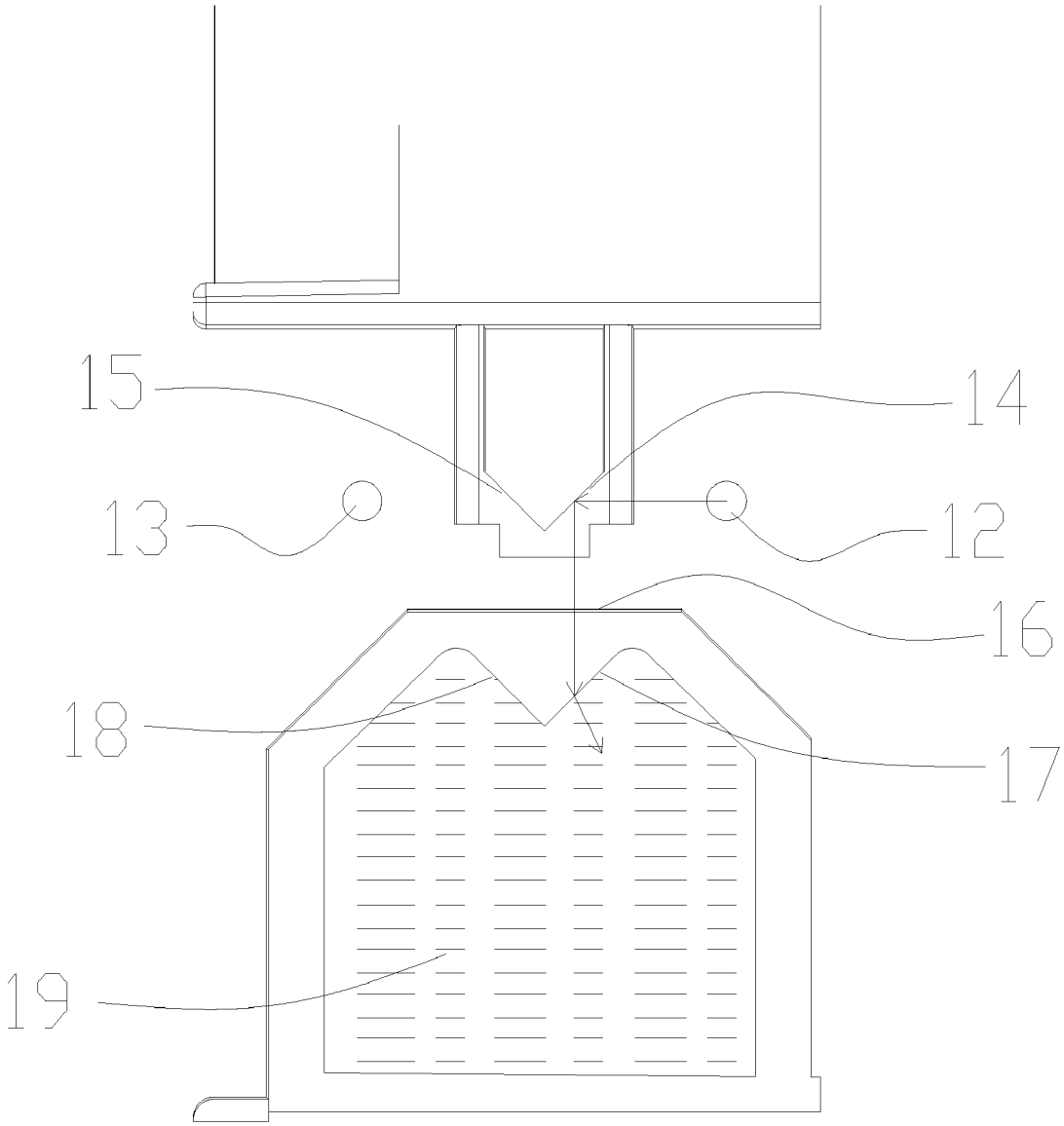
FIG. 2 is an optical path diagram of the embodiment in FIG. 1.

When the ink cartridge contains ink, the ink cartridge is installed into a printer for printing. FIG. 2 is an optical path diagram at this stage. As shown in FIG. 2, a light emitting element of the printer is indicated as 12, a light receiving element is indicated as 13, and arrows indicate the light transmission path. The first surface 14 of the first triangular prism 1 reflects the light emitted by the light emitting element 12 of the printer onto a third surface 16 of the second triangular prism 2, and the light is then incident onto a first surface 17 of the second triangular prism 2. At this time, as the space below the second triangular prism 2 is filled with ink 19 (the side seal membrane 7 is attached to seal the portion). According to the light refraction principle, the light is directly incident into the ink 19 and will not be received by the light receiving element 13 of the printer, and thus the printer recognizes that the ink cartridge contains ink accordingly.

Figure 3:
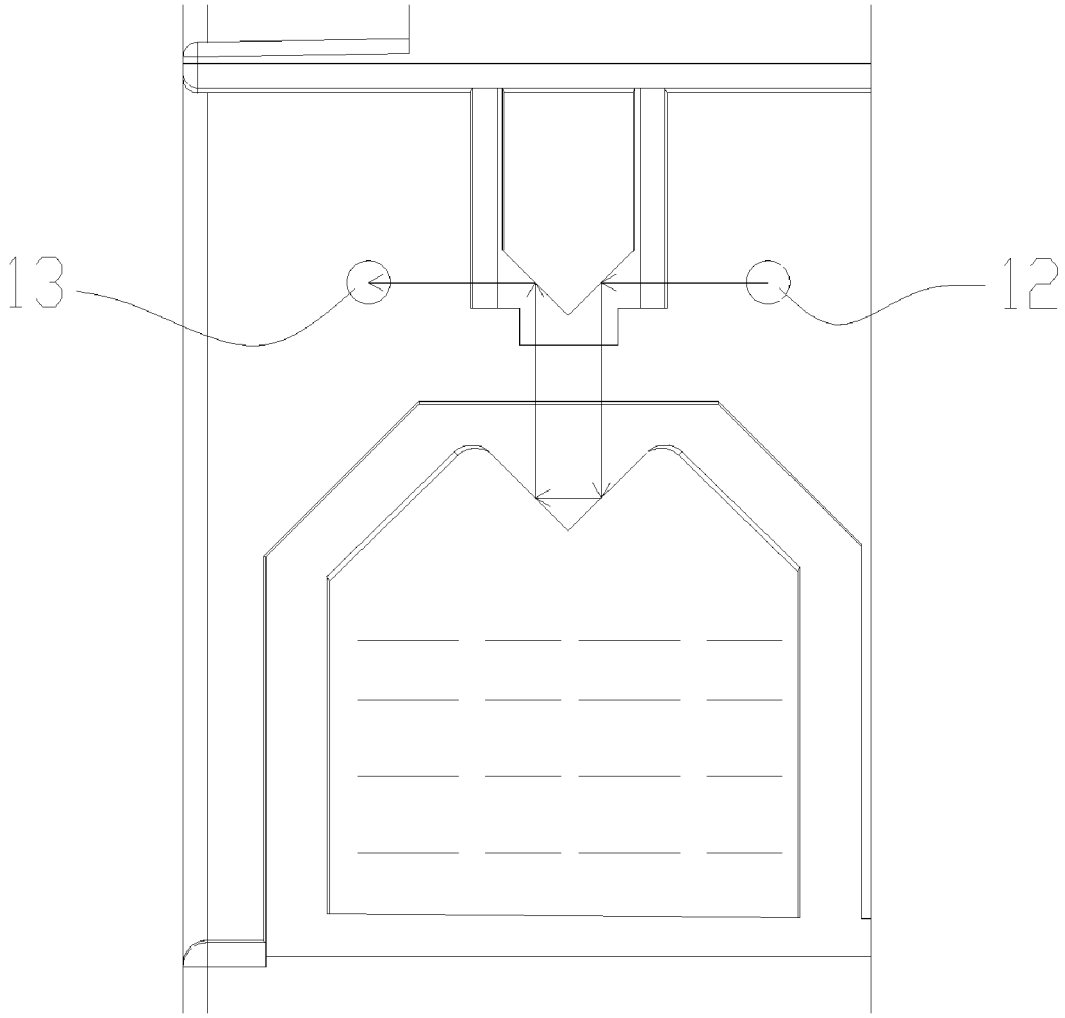
FIG. 3 is another optical path diagram of the embodiment in FIG. 1.

As printing continues, the volume of the ink in the ink cartridge decreases continuously. When the ink in the ink cartridge is exhausted, the ink adjacent to the second triangular prism 2 in the ink cartridge is consumed. FIG. 3 is an optical path diagram when the ink is exhausted, wherein arrows indicate the light transmission path. As shown in FIGS. 2 and 3, the first surface 14 of the first triangular prism 1 reflects the light emitted by the light emitting element 12 of the printer onto the third surface 18 of the second triangular prism 2, and the light is reflected onto the first surface 16 of the second triangular prism 2 by the third surface 18. According to the total reflection principle, the light is reflected to the second surface 17 of the second triangular prism 2, and is reflected onto the second surface 15 of the first triangular prism 1, and then is reflected onto the light receiving element 13. Thus, the printer prompts that the ink is exhausted, and then sends a signal to remind the user to replace the ink cartridge.

Second Embodiment

Figure 4:
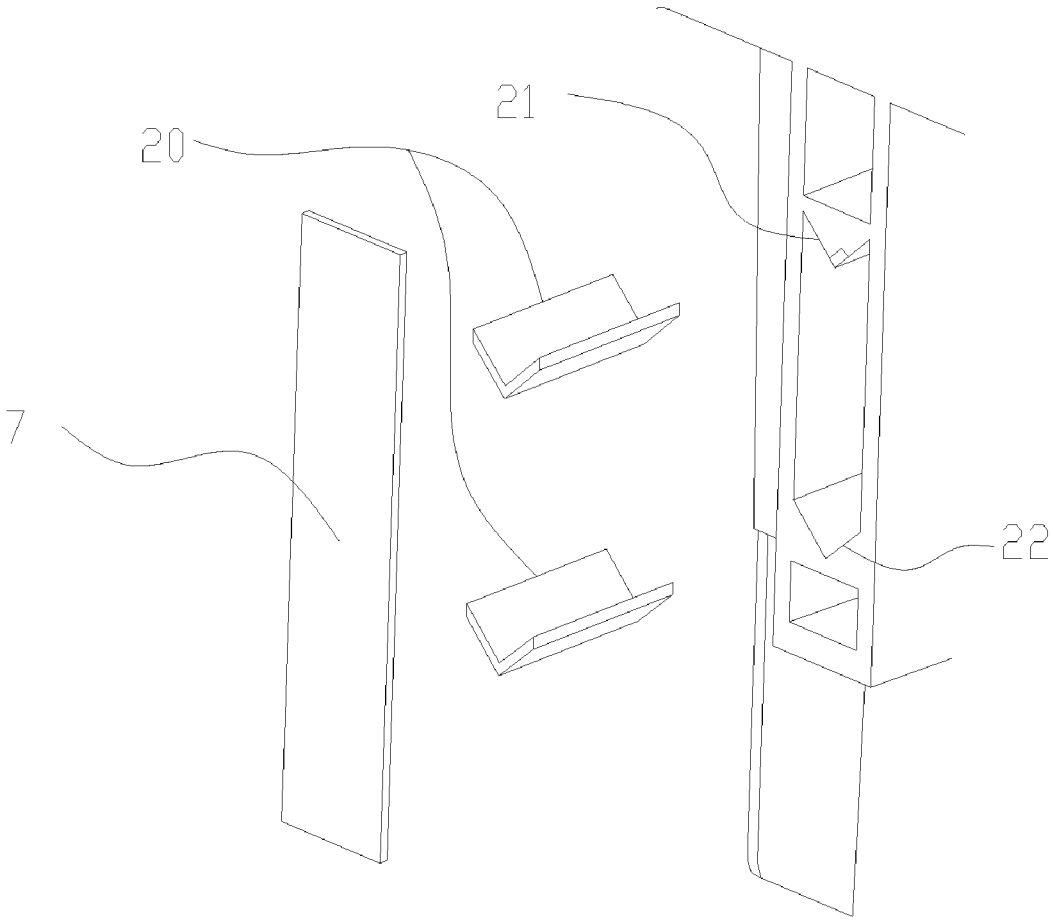
FIG. 4 is a structural schematic view of a second embodiment of the present utility model.
Figure 5:
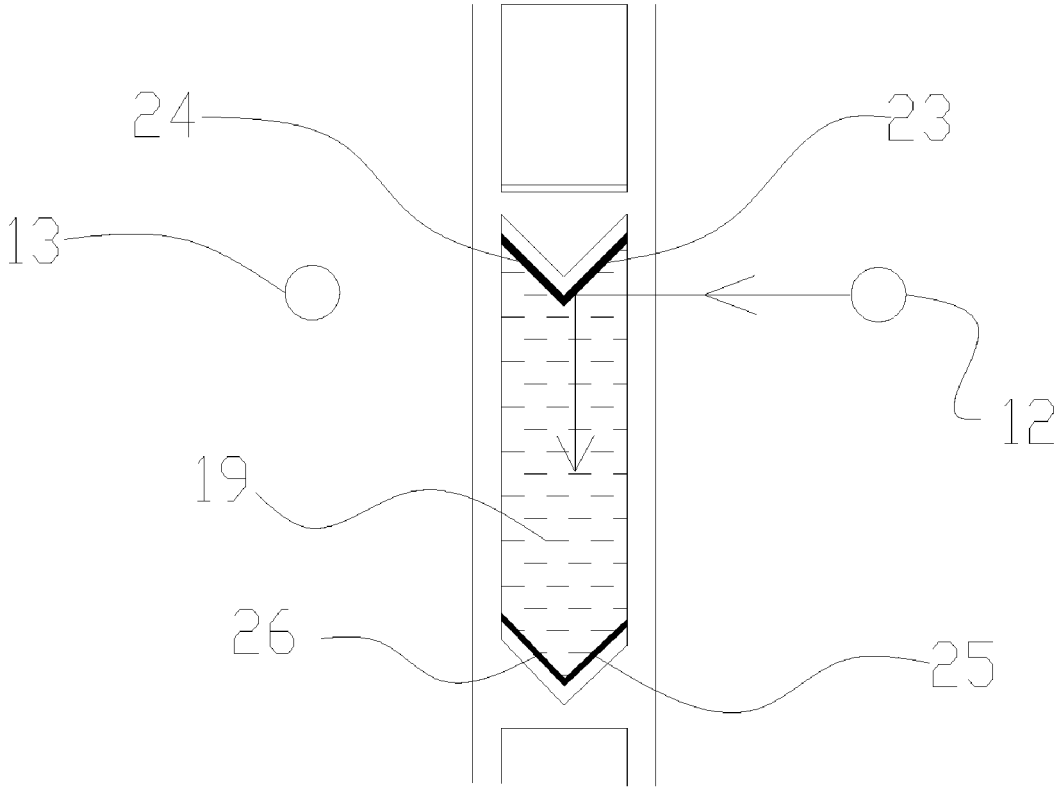
FIG. 5 is an optical path diagram of the embodiment in FIG. 4.

FIG. 4 is a schematic view of the second embodiment. Compared with the first embodiment, the difference lies in that a first right angle 21 and a second right angle 22 made of transparent material are disposed on a detection portion of the bottom shell to replace the first triangular prism 1 and the second triangular prism 2 in the first embodiment. The detection principle is substantially the same as that of the first embodiment. The two right angles are disposed at an angle of 45 degrees along the center line of the detection portion, and a distance between the two right angles is 1-15 mm As shown in FIG. 5, a first outer surface 23 and a second outer surface 24 of the first right angle 21 and a first inner surface 25 and a second inner surface 26 of the second right angle 22 are attached with reflective paper 20, respectively. A space between the two right angles is sealed with the side seal membrane 7 from outside, so as to seal the portion, and the ink accommodated in the space is in fluid communication with the ink in the ink cartridge.

FIG. 5 shows light transmission when the ink cartridge containing ink therein is installed into the printer. As shown in FIG. 5, the first outer surface 23 of the first right angle 21 reflects the light emitted by the light emitting element 12 into the ink 19, and the light is absorbed by the ink and cannot reach the light receiving element 13 of the printer. Thus, the printer recognizes that the ink cartridge contains ink therein.

Figure 6:
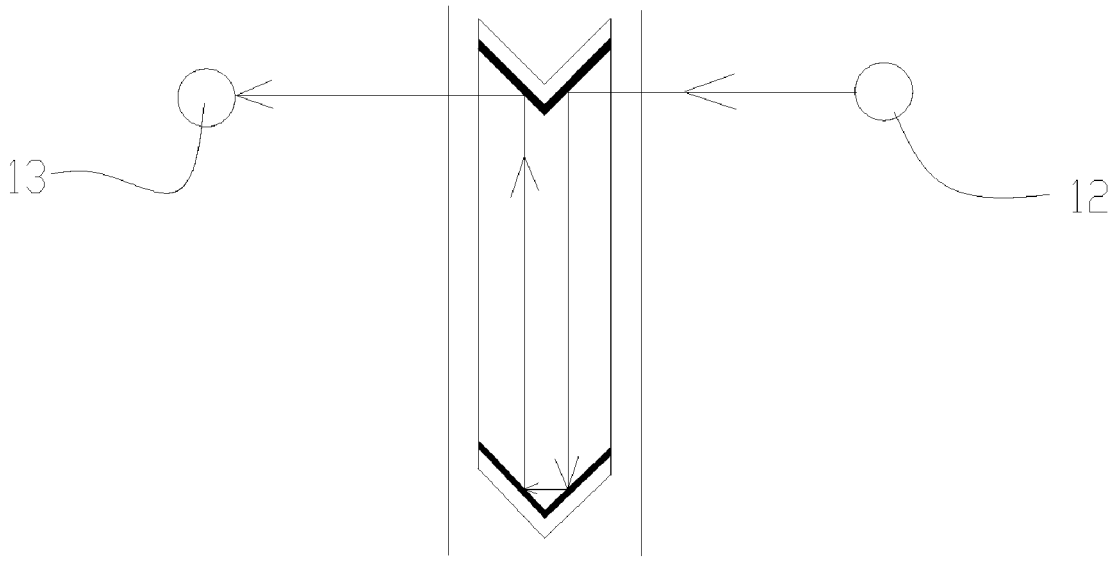
FIG. 6 is another optical path diagram of the embodiment in FIG. 4.

FIG. 6 is a light-path diagram when the ink in the ink cartridge is exhausted, wherein the path of the light is as shown by the arrows. As printing continues, the ink in the ink cartridge is exhausted, and the ink between the first right angle and the second right angle is consumed. The first outer surface of the first right angle directly reflects the light emitted by the light emitting element 13 onto the first inner surface of the second right angle, and the light is reflected to the second inner surface of the second right angle, and then is reflected onto the second outer surface of the first right angle, and finally is reflected onto the light receiving element 13 at the detection position of the printer. Thus, the printer prompts that the ink is exhausted and the ink cartridge needs to be replaced.

Figure 7:
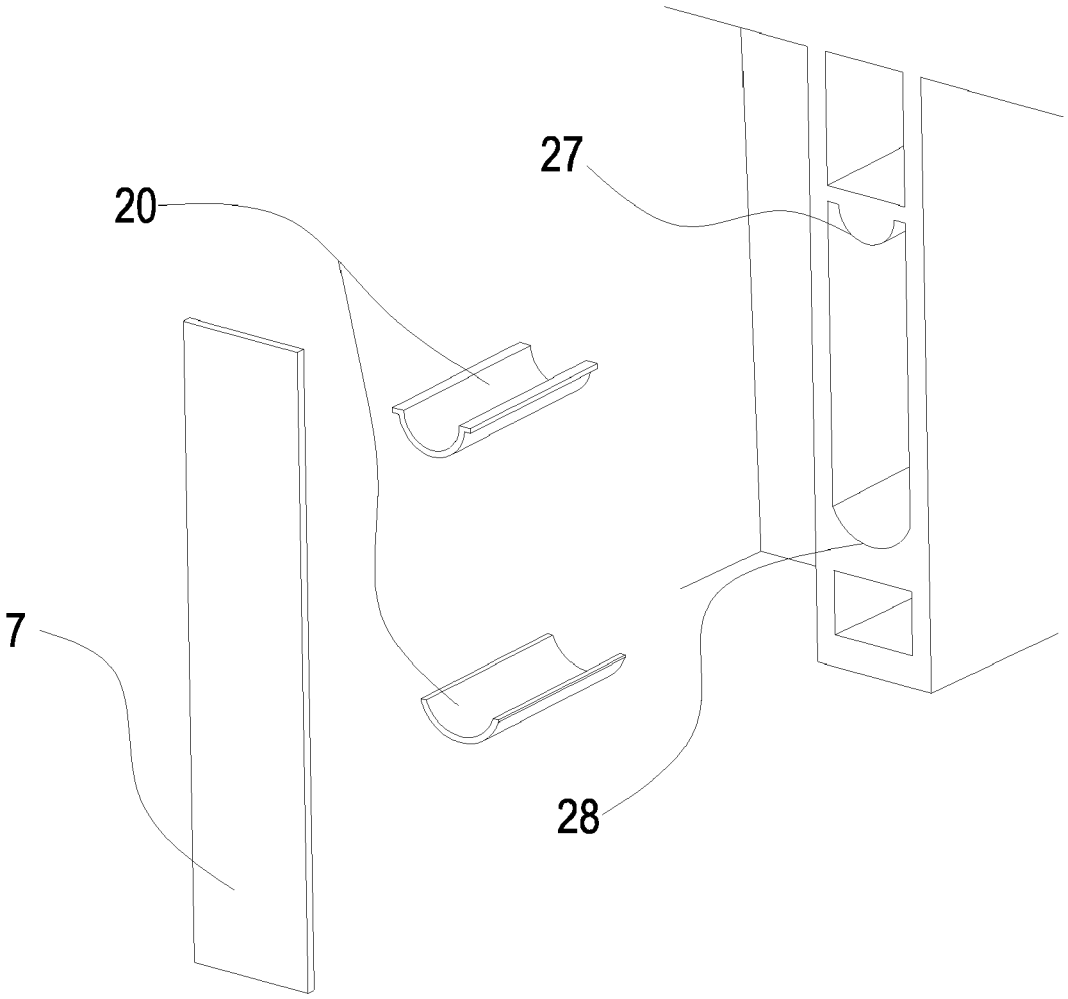
FIG. 7 is a structural schematic view of another embodiment of the present utility model.
Figure 8:
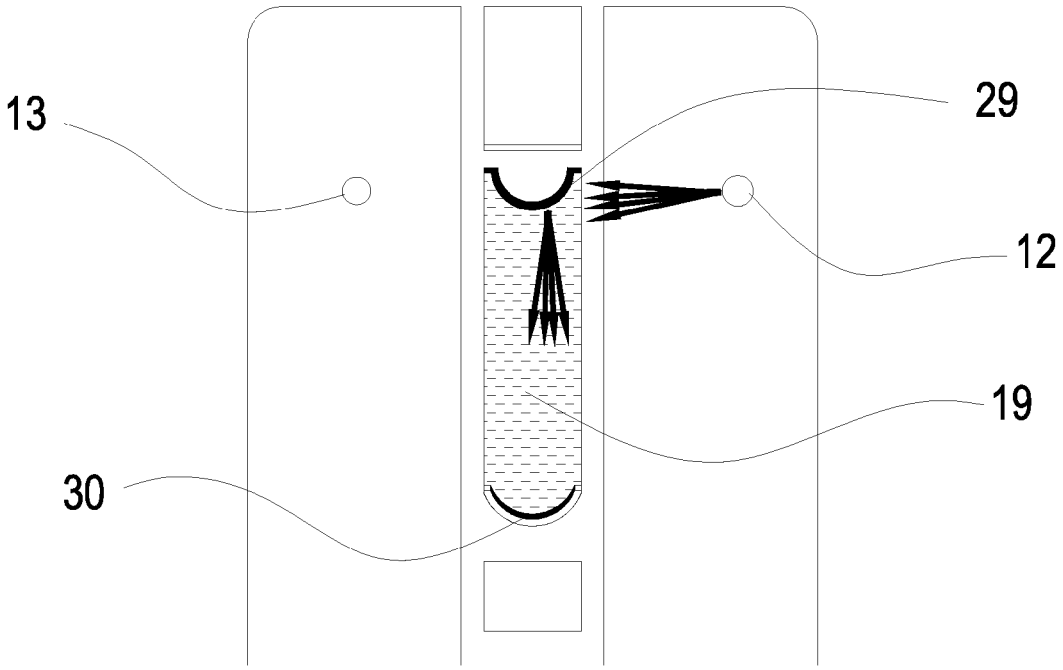
FIG. 8 is an optical path diagram of the embodiment in FIG. 7.
Figure 9:
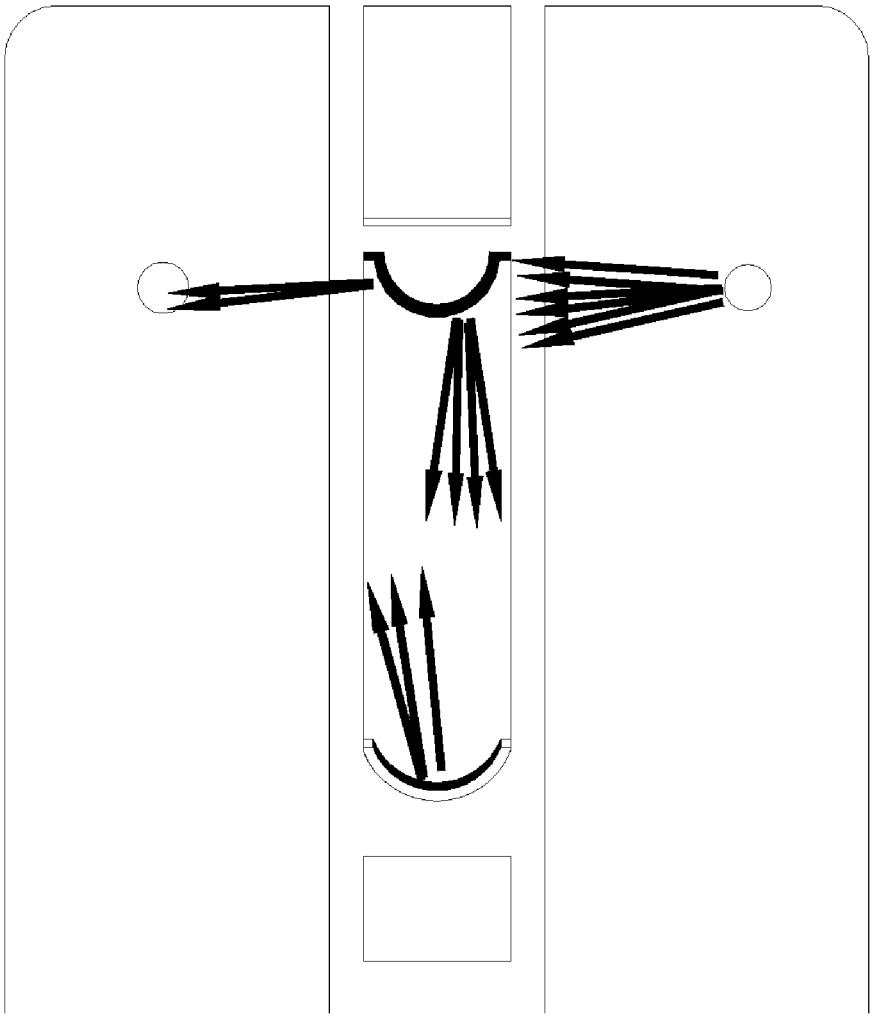
FIG. 9 is another optical path diagram of the embodiment in FIG. 7.

According to the second embodiment, the two right angles may further be configured as two curved surfaces (as shown in FIG. 7), and a distance between the first curved surface 27 and the second curved surface 28 is 1-15 mm When the first curved surface 27 and the second curved surface 28 are attached with reflective paper 20 [to form a first curved reflective surface 29 and a second curved reflective surface 30, respectively], and ink exists between the two surfaces (as shown in FIG. 8), the light emitted by the light emitting element 12 is incident onto the first curved reflective surface 29 and is scattered. The scattered light is incident into the ink 19 and cannot reach the light receiving element 13 at the detection portion of the printer, and thus the printer recognizes that the ink cartridge contains ink therein and will not send an ink exhausting prompt. When the ink between the first curved surface 27 and the second curved surface 28 is consumed up (as shown in FIG. 9), part of the scattered light is incident onto the second curved reflective surface 30 and is scattered again. A part of the light is incident onto the first curved reflective surface 29 and is scattered again. A part of the light is incident onto the light receiving element 13 at the detection position of the printer, and thus the printer recognizes that the ink is exhausted accordingly.

Figure 10:
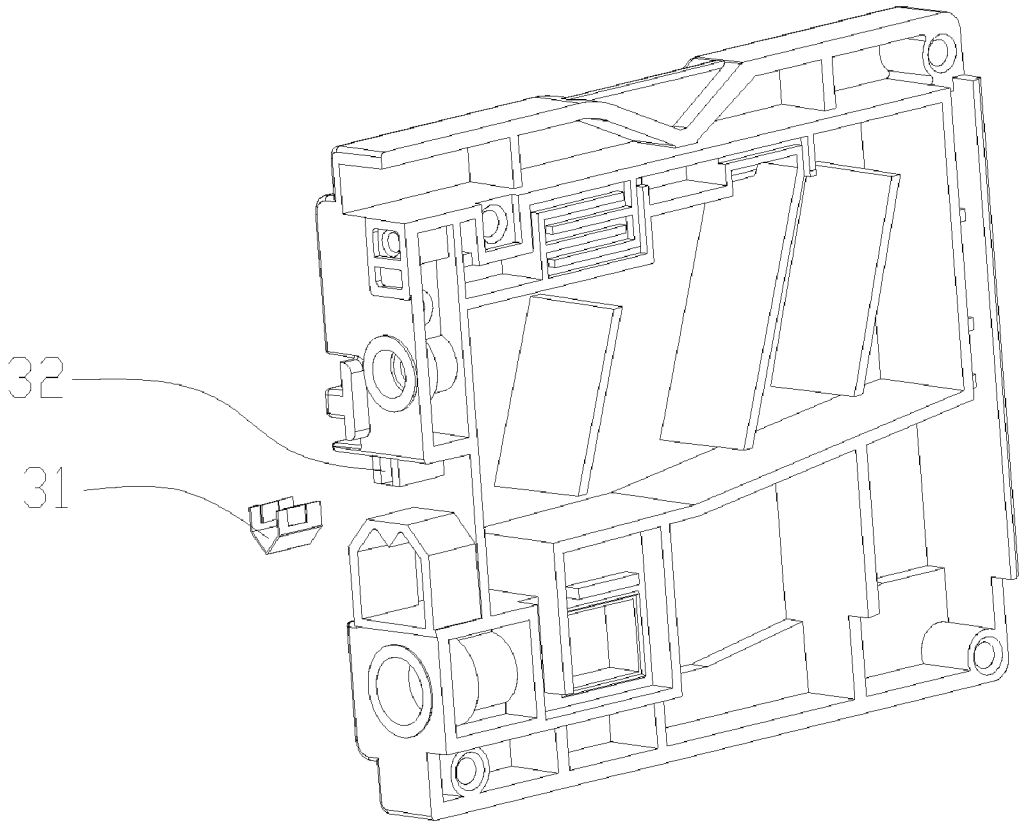
FIG. 10 is a structural schematic view of another embodiment of the present utility model.

According to the first embodiment, in order to avoid low production efficiency caused by mold-related problems, as shown in FIG. 10, a metal reflective element 31 can be used to replace the first triangular prism. In production, a metal reflective element 31 can be sleeved onto a positioning column 32 to reflect light, so as to achieve the same function of the triangular prism.

Figure 11:
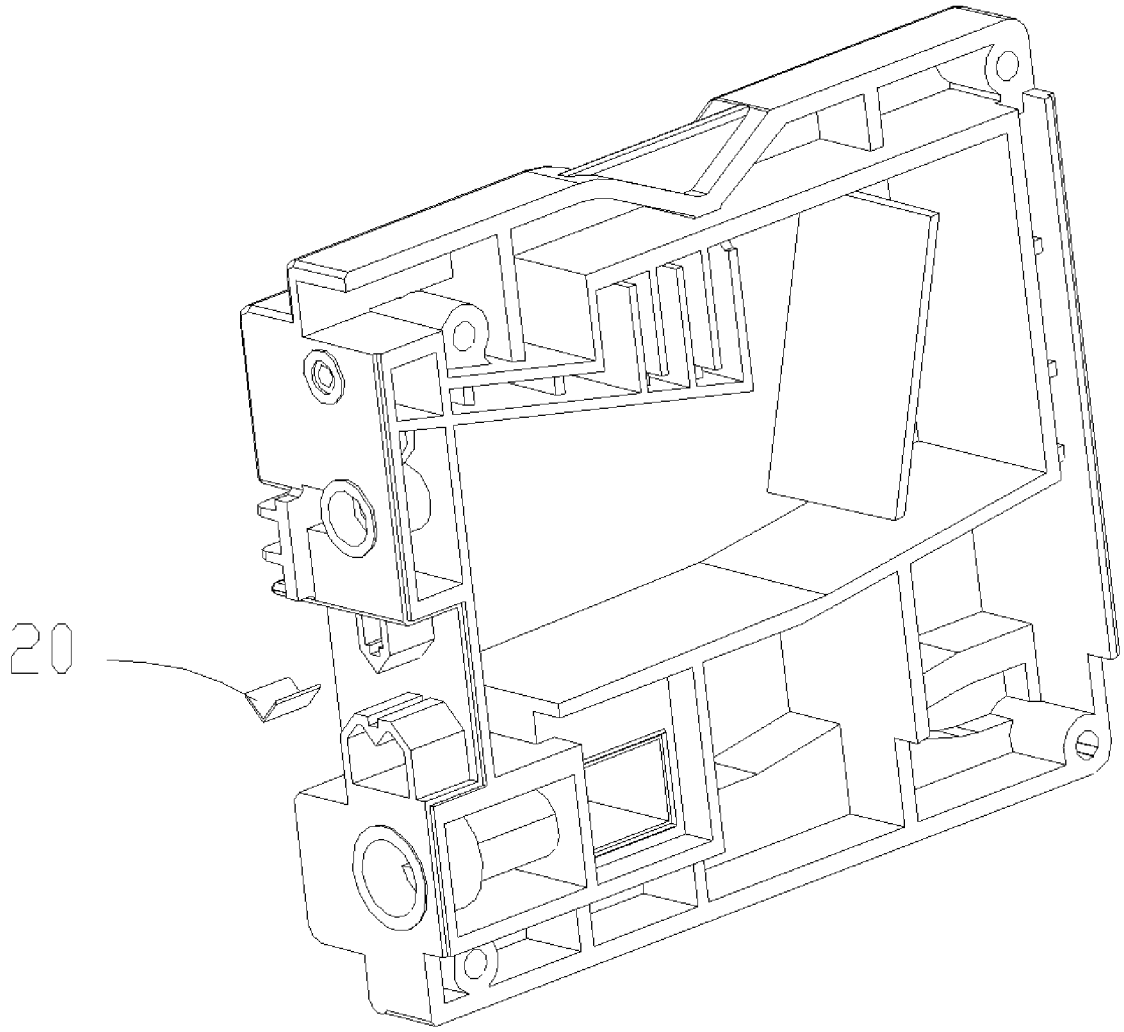
FIG. 11 is a structural schematic view of another embodiment of the present utility model.

According to the first embodiment, as shown in FIGS. 1, 2 and 11, a space between two side surfaces of the first triangular prism 1 may be made solid, the two side surfaces are attached with reflective paper 20, and two side surfaces of the second triangular prism 2 contact the ink. When there is ink, the light is reflected onto the second triangular prism 2 by the reflective paper 20, and is refracted into the ink, and the printer prompts that there is ink. When the ink is used to a level below the second triangular prism 2, the light is reflected onto the second triangular prism 2 and is totally reflected by a side surface 17 of the second triangular prism 2, is reflected onto a side surface 18 of the second triangular prism 2, and is reflected onto a side surface 15 of the first triangular prism 1, and then is reflected back to the light receiving element 13, and the printer prompts that the ink is exhausted accordingly.

What is claimed is:

1. An ink cartridge for an inkjet printer, comprising an ink supply port, an air vent, an ink chamber for accommodating ink to be supplied to the printer and a light detection portion, wherein the light detection portion comprises a first triangular prism and a second triangular prism, the second triangular prism is formed by transparent material, the first triangular prism has a first surface and a second surface for reflecting light emitted by a light emitting element, the second triangular prism has a second surface and a third surface, the first surface and the second surface of the first triangular prism are aligned with the second surface and the third surface of the second triangular prism, respectively, so that the light is reflected onto the second surface of the second triangular prism by the first surface of the first triangular prism when the light is emitted by the light emitting element onto the first surface of the first triangular prism, wherein when the ink cartridge contains sufficient ink, the second surface of the second triangular prism refracts the light reflected from the first surface of the first triangular prism into the ink, and when the ink in the ink cartridge is exhausted the second surface of the second triangular prism reflects the light reflected from the first surface of the first triangular prism onto the third surface of the second triangular prism.

2. The ink cartridge for the inkjet printer according to claim 1, wherein a distance between the first triangular prism and the second triangular prism is 1-12 mm, the first triangular prism is made hollow so as to be filled with air or other substances having a density lower than that of the material of the first triangular prism.

3. The ink cartridge for the inkjet printer according to claim 1, wherein the first triangular prism is made solid, and at least one surface of the first triangular prism is attached with reflective paper to reflect the light.

4. The ink cartridge for the inkjet printer according to claim 1, wherein the third surface of the second triangular prism reflects the light onto the second surface of the first triangular prism, the second surface of the first triangular prism reflects the light from the third surface of the second triangular prism to a light receiving element.

5. An ink cartridge for an inkjet printer, comprising an ink supply port, an air vent, an ink chamber for accommodating ink to be supplied to the printer and a light detection portion, wherein the light detection portion comprises a first reflective element having a convex surface and a second reflective element having a concave surface, the second reflective element is formed by transparent material, the convex surface of the first reflective element has a first surface portion and a second surface portion, light is emitted by a light emitting element onto the first surface portion of the convex surface, but not onto the second surface portion of the convex surface, the concave surface of the second reflective element has a first surface portion and a second surface portion, the convex surface of the first reflective element faces and is aligned with the concave surface of the second reflective element, so that the light is reflected onto the first surface portion of the concave surface of the second reflective element by the first surface portion of the convex surface of the first reflective element when the light is emitted by the light emitting element onto the first surface portion of the convex surface of the first reflective element, wherein when a space between the convex surface and the concave surface is not filled with the ink, the light reflected from the first surface portion of the convex surface of the first reflective element is reflected by the first surface portion of the concave surface of the second reflective element onto the second surface portion of the concave surface and, then, reflected by the second surface portion of the concave surface onto the second surface portion of the convex surface of the first reflective element, and when the space between the convex surface and the concave surface is filled with the ink, the light reflected from the first surface portion of the convex surface of the first reflective element is absorbed by the ink and cannot be reflected by the first surface portion of the concave surface of the second reflective element.

6. The ink cartridge for the inkjet printer according to claim 5, wherein the first reflective element and the second reflective element are a right angle, respectively.

7. The ink cartridge for the inkjet printer according to claim 5, wherein the first reflective element and the second reflective element are made of curved sheet, respectively.

8. The ink cartridge for the inkjet printer according to claim 5, wherein the convex surface of the first reflective element and the concave surface of the second reflective element are covered by a reflective material, respectively.

9. The ink cartridge for the inkjet printer according to claim 5, wherein the first reflective element is made of reflective metal material.

10. An ink cartridge for an inkjet printer, comprising an ink supply port, an air vent, an ink chamber for accommodating ink to be supplied to the printer and a light detection portion, wherein the light detection portion comprises a metal reflective element and a second triangular prism, the second triangular prism is formed by transparent material, the metal reflective element has a first surface and a second surface for reflecting light emitted by a light emitting element, the second triangular prism has a second surface and a third surface, the first surface and the second surface of the metal reflective element are aligned with the second surface and the third surface of the second triangular prism, respectively, so that the light is reflected onto the second surface of the second triangular prism by the first surface of the metal reflective element when the light is emitted by the light emitting element onto the first surface of the metal reflective element, wherein when the ink cartridge contains sufficient ink, the second surface of the second triangular prism refracts the light reflected from the first surface of the metal reflective element into the ink, and when the ink in the ink cartridge is exhausted the second surface of the second triangular prism reflects the light reflected from the first surface of the metal reflective element onto the third surface of the second triangular prism; a distance between the metal reflective element and the second triangular prism is 1-15 mm.

* * * * *